United States Patent [19]

Barnard

[11] 3,999,596

[45] Dec. 28, 1976

[54] REGENERATOR MATRIX STRUCTURE

[75] Inventor: James A. Barnard, Lockport, N.Y.

[73] Assignee: General Motors Corporation, Detroit, Mich.

[22] Filed: Oct. 15, 1975

[21] Appl. No.: 622,664

[52] U.S. Cl. ..... 165/8; 165/10; 29/157.3 R

[51] Int. Cl.[2] ..... F28D 19/00

[58] Field of Search ..... 165/8, 10; 29/157.3 R

[56] References Cited

UNITED STATES PATENTS 3,875,994 4/1975 Lewabowski et al. ..... 165/8

*Primary Examiner*—Albert W. Davis, Jr.
*Attorney, Agent, or Firm*—Arthur N. Krein

[57] ABSTRACT

A matrix structure for a rotary regenerator includes a hub and a plurality of matrix elements, each secured at one end to the outer periphery of the hub, and spirally wound in an involute configuration about the hub and fixed together, as by brazing, into a rigid, elastic structure. Each of the matrix elements includes, in series, a corrugated strip of predetermined length, an inner shim strip extending along one side of the corrugated strip for approximately half of the length thereof, the corrugated strip having a return bent portion and a folded back portion which extends along the opposite side of the inner shim strip and, an outer shim strip extending along the opposite side of the fold-back portion from the inner shim strip and around the return bent portion, the portion of the outer shim strip extending around the return bent portion serving as the means by which the matrix element is secured to the hub.

2 Claims, 3 Drawing Figures

REGENERATOR MATRIX STRUCTURE

This invention relates to a rotary regenerator disk and, in particular, to an improved multi-start involute matrix core structure for such a regenerator disk and to the method of fabricating such a matrix core structure.

Rotary regenerators, particularly of the axial flow type as used in gas turbine engines, utilize heat transfer means in the form of a porous metal disk matrix which is rotated so that each element thereof passes successively through two aeriform fluid flow paths, absorbing heat from a hotter fluid and releasing it to a cooler fluid in these flow paths.

Metal matrices ordinarily are made up of corrugated metal sheets spirally wound into a disk and then brazed or otherwise bonded together so as to provide a rigid cellular or porous structure. This rigid cellular or porous structure is normally enclosed at the outer peripheral edge thereof by outer sealing rings or by an outer ring which provides a solid rim around the periphery around the matrix. Alternately, the outer peripheral edge of the matrix may be suitably secured to a driven ring gear in a known manner.

The conventional inner core structure or main heat transfer body of such an axial flow regenerator matrix disk involves alternating flat and corrugated strips or alternating corrugated strips which are spirally wound about a hub to form the main heat transfer body of the matrix. One example of such an alternating flat strip and corrugated strip structure is illustrated in U.S. Pat. No. 3,276,515 for "Gas Turbine Regenerator" issued Oct. 4, 1966 to James H. Whitfield. An example of a matrix structure using alternating corrugated strips is illustrated in U.S. Pat. No. 3,532,157 entitled "Regenerator Disk" issued Oct. 6, 1970 to William S. Hubble.

The process of forming such a matrix structure composed of a pair of strips spirally wound around a central core or hub is such that compressive loads are inherent in the critical make-up of the matrix structure, with each successive wrap of the strips adding to the load of those spiral wraps radially inward thereof toward the core and, for example, with a matrix diameter of 25 inches, this compressive load on the radially innermost wrap can be significant. Thus, both from the standpoint of manufacturing and service, such loading can produce undesirable results, such as fracturing, faults, voids and separations of the strips forming these wraps.

As an alternate to such a matrix structure, as above described, it has been proposed to use a plurality of pairs of strips spirally wound in an involute fashion around a central tubular core in the form of a hub in an effort to reduce the compressive loading on the radially innermost wraps of the matrix structure. This form of matrix structure can be referred to as a multi-start involute matrix structure. However, one of the problems encountered in forming such a multi-start involute matrix structure is in attaching the starting ends of the pairs of strips to the core or hub of the matrix disk. The complexity of attaching such pairs of strips to the core or hub can be readily appreciated when one considers that as many as 32 to 64 such pairs of strips may be attached to the outer periphery of a hub element prior to spiral wrapping of the strips around this hub element.

It is therefore the primary object of this invention to provide an improved regenerator matrix structure, and a method of fabricating the same, having a strong matrix disk structure with a uniform core density.

Another object of this invention is to provide an improved regenerator matrix structure wherein the main heat transfer matrix core of such a regenerator is in the form of multi-start involute spirally wound matrix elements, each consisting of a folded-over corrugated strip separated by an inner shim strip and having an outer shim strip engaging a folded-over section of the corrugated strip with a portion of the outer shim strip being used to effect securement of the corrugated strip and the inner shim strip to the hub of the matrix disk as a unit assembly.

A further object of this invention is to provide a multi-start involute regenerator matrix structure fabricated by using a plurality of matrix elements, each of which includes a substantially centrally folded-over corrugated strip, the folded-over portions of which are separated by an inner shim strip, and an outer shim strip extending along the opposite side of a folded-over portion of the corrugated strip from the inner shim strip, the outer shim strip also being folded around the folded-over portion of the corrugated strip with this portion of the outer shim strip being secured to the hub of the regenerator disk.

A further object of this invention is in the provision of a regenerator matrix structure of simplified construction which eliminates many of the fabricating complexities inherent in prior devices of the same type, thus providing a comparatively inexpensive regenerator matrix structure.

These and other objects of the invention are obtained in a preferred embodiment by means of a multi-start involute chevron regenerator disk fabricated using a plurality of matrix elements each of which includes in series, a chevron strip of predetermined length, an inner shim strip extending along one side of the chevron over approximately half the length of the chevron strip which is then bent and folded back over along the opposite face of the inner shim strip and, an outer shim strip extending along the opposite side of the folded-over portion of the chevron strip from the inner shim strip and around the return bent portion of the chevron strip, this latter portion of the outer shim strip being welded to the hub of the matrix prior to spiral winding of these elements around the hub.

For a better understanding of the invention, as well as other objects and further features thereof, reference is had to the following detailed description of the invention to be read in connection with the accompanying drawings, wherein.

Figure 1:
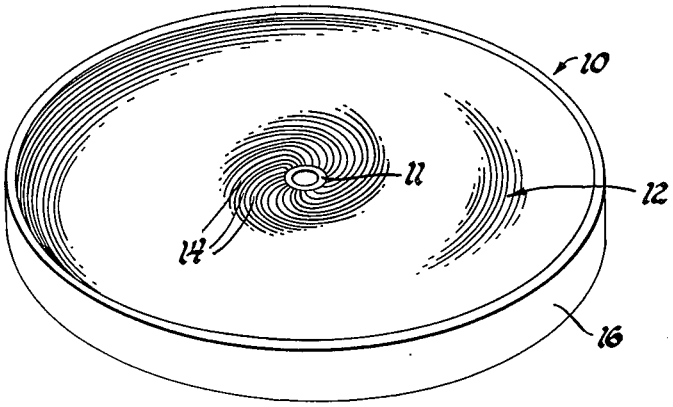
FIG. 1 is a top perspective view of a multi-start involute regenerator matrix disk structure in accordance with the subject invention, the matrix elements thereof, due to their size, being shown schematically.

Referring now to the drawings, there is shown in FIG. 1 an axial flow regenerator matrix structure 10. Since such a regenerator matrix structure may be over 2 feet in diameter with a thickness of only about 3 inches, it will be apparent that the illustration thereof in FIG. 1 is exaggerated to show the separate elements, to be described, of this structure.

The matrix structure 10 includes a cylindrical hub 11 which may include means, not shown, for connecting the hub to a matrix driving shaft, such as disclosed in U.S. Pat. No. 3,476,173 for "Rotary Regenerator Matrix Mount and Drive" issued Nov. 4, 1969 to Joseph W. Bracken, Jr. and William S. Hubble. The matrix further includes a cylindrical or disk-shaped main body or inner core 12 of heat transfer material which, in accordance with the invention, is formed by a plurality of matrix elements 14, to be described in detail hereinafter, each of which is secured at one end, as by welding, to the outer periphery of the hub 11 and then spirally wrapped around the hub in an involute configuration so as to define passages extending generally axially of the matrix. In the structure shown, the matrix 10 also includes an outer rigid rim 16, herein shown as a one-piece ring with which the rim seals, not shown, of the regenerator cooperate, the rim extending around the outer periphery of the inner core 12 of the matrix. It should be realized, however, that the rigid rim 16 could, if desired, be replaced by a ring gear or, alternately, the matrix structure could terminate, if desired, at the outer periphery of the inner core 12.

Figure 2:
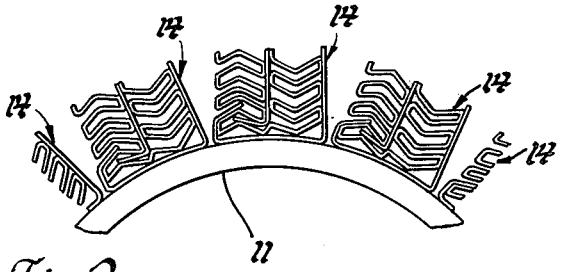
FIG. 2 is a top view of a central core portion of the matrix disk structure of FIG. 1, showing schematically the arrangement of matrix elements secured to the hub of the matrix disk during the fabrication of the matrix structure; and, FIG. 3 is an enlarged top view of the attachment end of a single matrix element showing the assembly of the components thereof prior to its attachment to a hub.
Figure 3:
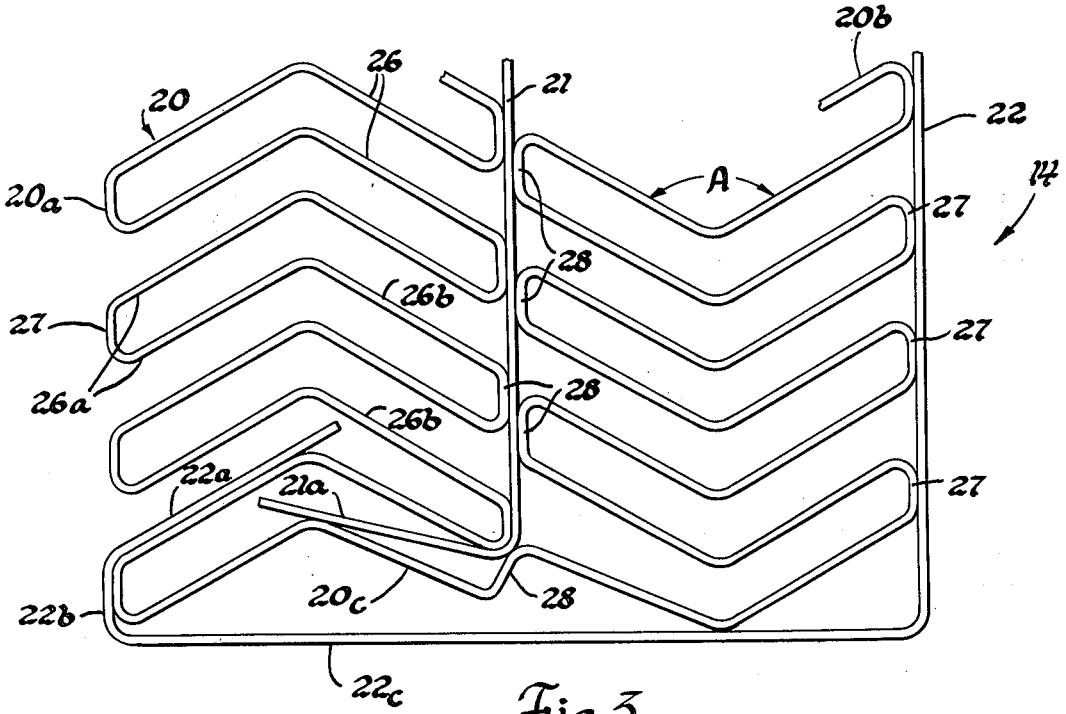

Now, in accordance with the invention, each matrix element 14 of the inner core 12, as best seen in FIGS. 2 and 3, is provided by means of a corrugated strip 20 of a predetermined length folded at approximately its midpoint over onto itself with a flat inner shim 21 extending between the folded-over sections or portions 20*a* and 20*b* of the strip 20. A flat outer shim strip 22 extends along a side of the portion 20*b* opposite shim 21, the shim strip 22 then being folded over and along the folded-over interconnecting portion 20*c* of the corrugated strip 20, in a manner to be described in greater detail hereinafter.

Although the corrugated strip 20 may be of any desired corrugated configuration, in the preferred embodiment illustrated, the corrugated strip 20 is in the form of a chevron matrix strip which includes closely spaced apart, substantially parallel fins 26 interconnected to each other at alternating ends, each fin 26 including diagonal first and second fin portions 26*a* and 26*b*, respectively, meeting together at an obtuse angle A, with each first fin portion 26*a* of a fin being connected by a flat crest 27 to the first fin portion 26*a* of the next adjacent fin on one side thereof and the second fin portion 26*b* thereof being connected by a flat valley 28 to the second fin portion 26*b* of the next adjacent fin on the opposite side thereof, the included angle A between each first and second fin portion of a fin being approximately 120° and the flat crests 27 and flat valleys 28 being substantially parallel to each other. In a particular embodiment, this chevron matrix strip, described above, is fabricated from a 0.002 inch thick metal foil having a width of 3 inches and is provided with 93 fins per 2 inches of chevron matrix strip material and, the height of the chevron matrix strip, that is, the distance from a flat crest 27 to a flat valley 28, was 0.129 inch. The flat shim strips 21 and 22 are made of stock material having a corresponding thickness. Accordingly, it will be realized that the chevron matrix strip material together with the shim strips, as shown in FIGS. 2 and 3, have been greatly enlarged to show the details of this chevron matrix strip structure.

In fabricating a matrix element 14, a predetermined length of the corrugated strip 20 would be folded back over itself, as by reversely bending a flat valley 28, as best seen in FIG. 2, to thereby provide the folded-over portions 20*a* and 20*b* with their interconnecting portion 20*c*, the inner shim 21 first being inserted between the portions 20*a* and 20*b* with its bent over tab portion 21*a*, at one end thereof, inserted between the separated fin portions 26*b* separating the portions 20*a* and 20*c* so that after folding over, the flat valleys 28 of the portion 20*a* will abut against the surface on one side of the inner shim 21 while the flat valleys 28 on the other portion 20*b* will abut against the surface on the other side of the inner shim 21, the inner shim 21 extending at least the full length of the folded-over portions 20*a* and 20*b*.

A free end 22*a* of the outer shim 22 is then inserted between the first set of non-interconnected first fin portions 26*a* of the portion 20*a* of corrugated strip 20, the outer shim 22 then being bent around the flat crests 27 adjacent to the interconnecting portion 20*c* and around the interconnecting portion 20*c* to provide a lock flat portion 22*b* and a shim fastening portion 22*c*, the latter in the construction shown being substantially at right angle to the lock flat portion 22*b* and to the main body portion of the outer shim 22 whereby the main body portion of the outer shim 22 will be positioned in abutment against the flat crests 27 of portion 20*b* of the matrix strip 20 to extend at least the full length of the portion 20*b*.

The thus assembled matrix element 14 is then secured to the outer peripheral surface of a hub 11 by positioning the shim fastener portion 22*c* into abutment against the outer peripheral surface of the hub after which this shim fastening portion 22*c* is secured to the hub 11, as by being welded thereto. Although the shim fastening portion 22*c* of the outer shim 22 is shown as having a flat profile in FIG. 3, it should be realized that when the matrix element 14 is abutted against the outer periphery of the hub 11, this shim fastening portion 22*c* will readily conform to the curvature of the outer periphery of the hub since the shim stock is a very thin metal foil.

As shown schematically in FIG. 2, a plurality of such matrix elements 14 will thus be secured around the outer periphery of the hub 11 in closely spaced relationship to each other, the number of such matrix elements 14 used in a particular matrix core structure depending, of course, on the outer diameter size of the hub 11. Each matrix structure 14 is secured to the hub so that after fabrication of the matrix disk structure, the corrugations of each of the corrugated strips 20 will define passages extending generally axially of the matrix through these corrugations and, as shown, the arrangement of the matrix elements 14 is such that the outer rim 22 of one matrix element will face the exposed flat crests 27 of the portion 20*a* of the next adjacent matrix element 14 whereby as these elements are spirally wound about the hub 11, these flat crests 27 will abut against this outer shim 22.

To complete fabrication of the matrix disk structure, the hub 11, with the matrix elements 14 secured thereto in the manner previously described, is mounted on a rotatable mandrel, not shown, to permit rotation of the core while the free ends of the matrix elements 14 are held under tension, to permit winding of the matrix elements spirally in an involute configuration about the hub until the required, predetermined, unfinished core diameter is achieved. After winding of the matrix elements 14 around the hub, the free ends of these matrix elements are then secured to each other as by stapling or by use of a suitable band, not shown, in a known manner around the outer periphery of the thus far assembled matrix core.

In a preferred embodiment, each of the inner and outer shims 21 and 22, respectively, would be of an original length greater than the original length of the fold-over matrix portions 20*a* and 20*b* of matrix strip 20 with which they are associated, so that during winding, these inner and outer shims, which are in effect separator shim strips, may be wrapped for at least one additional revolution after termination of the wrapping of the corrugated portions 20*a* and 20*b* and, then these shims would be stapled or otherwise secured to each other whereby to temporarily retain these elements together prior to their being permanently secured together.

The above described assembly of hub and matrix elements 14 forming core 12 may then be removed from the mandrel after which the plurality of matrix elements 14 and the components thereof are brazed or otherwise bonded together, in a known manner, so as to provide a rigid cellular or porous matrix structure. After bonding together of the matrix elements 14, the outer periphery of the inner core 12, formed by the bonded matrix elements 14, is machined to the desired outer finished diameter for the inner core 12. After being machined, an outer rigid rim 16, or ring gear, if desired, may be attached to the outer peripheral surface of the inner core 12 in a known manner.

In the construction shown, with the bent-over portion of the inner and outer shims 21 and 22, respectively, inserted into the folds (between fins) of the chevron strip 20, as shown, these elements are suitably retained together as a unit assembled matrix element 14 for securement to the hub 11, in the manner previously described. However, it should be realized that, if desired, these shims could be selectively secured to the corrugated strip 20, for example, as by welding prior to being attached to the hub 11.

Although, in the embodiment illustrated, the inner and outer shims 21 and 22, respectively, are shown as being fabricated from flat shim stock, it is to be realized that either one of these shims or both may be fabricated from a very shallow corrugated shim stock, for example, of a corrugated separator shim stock having the configuration as disclosed in the above identified U.S. Pat. No. 3,532,157.

What is claimed is:

1. A regenerator matrix structure includes a central hub, a plurality of matrix elements, each said matrix element being secured at one end to said hub and spirally wound in involute configuration about said hub and bonded to each other, each of said matrix elements including in series a chevron strip of predetermined length, an inner shim strip extending along one side of said chevron strip of approximately half the total length of said chevron strip, said chevron strip having a return bent portion and a folded back over portion extending along the opposite face of said inner shim strip and, an outer shim strip extending along the opposite side of said folded over portion of said chevron strip from said inner shim strip and around said return bent portion of said chevron strip, said portion of said outer shim strip extending around said return bent portion of said chevron strip being the portion of said matrix element which is secured at said one end to said hub.

2. A rotary regenerator matrix structure of annular form porous to flow of fluid generally parallel to the axis of the matrix, said matrix structure including a cylindrical hub and a plurality of matrix elements each fixed at one end to the outer peripheral surface of said hub and spirally wound about said hub in an involute configuration with each turn of one of said matrix elements disposed between turns of the next adjacent ones of said matrix elements in face-to-face abutment therewith and fixed together into a rigid, elastic structure, each one of said matrix elements including a corrugated strip having corrugations trending parallel to the axis of said hub, said corrugated strip being folded over to provide a first fold portion and a second fold portion connected by a return bent portion, an inner shim strip extending from adjacent said return bent portion in abutment between said first fold portion and said second fold portion and an outer shim strip extending in abutment against said second fold portion on the side thereof opposite said inner shim strip and around at least said return bent portion, said portion of said outer shim strip extending around said return bent portion being fixed to the outer peripheral surface of said hub.

* * * * *